United States Patent [19]

Suzuki et al.

[11] 4,270,472

[45] Jun. 2, 1981

[54] INDICATION ARRANGEMENT FOR USE IN A SEWING MACHINE

[75] Inventors: Kazuo Suzuki, Higashiosaka; Hirokazu Koda, Gose; Kenichi Nakamura, Nara; Syuich Yoshikawa, Yamatokooriyama; Naoki Ohara, Toyota, all of Japan

[73] Assignees: Sharp Kabushiki Kaisha, Osaka; Aisin Seiki Kabushiki Kaisha, Aichi, both of Japan

[21] Appl. No.: 47,707

[22] Filed: Jun. 12, 1979

[30] Foreign Application Priority Data

Jun. 13, 1978 [JP] Japan ..... 53-71714

[51] Int. Cl.[3] ..... D05B 79/00; D05B 3/02

[52] U.S. Cl. ..... 112/158 E; 112/158 F; 112/158 A

[58] Field of Search ..... 112/158 A, 158 D, 158 E, 112/158 F, 158 R

[56] References Cited

U.S. PATENT DOCUMENTS

| | | | |
|---|---|---|---|
| 4,005,664 | 2/1977 | Garron | 112/158 E |
| 4,063,525 | 12/1977 | Sasaki | 112/158 A |
| 4,064,817 | 12/1977 | Sawada et al. | 112/158 F |
| 4,084,523 | 4/1978 | Kasuga | 112/158 A |

*Primary Examiner*—Peter P. Nerbun

*Attorney, Agent, or Firm*—Birch, Stewart, Kolasch & Birch

[57] ABSTRACT

A zigzag sewing machine of a sewing pattern selectable type is disclosed having a cloth advancing mechanism for advancing a cloth at a predetermined pitch after every one stitch and a pitch control dial for controlling the length of said pitch. A plurality of indication lamps are disposed around the control dial for indicating an available range for the selected sewing pattern.

11 Claims, 6 Drawing Figures

INDICATION ARRANGEMENT FOR USE IN A SEWING MACHINE

BACKGROUND OF THE INVENTION

The present invention relates to an electric sewing machine and, more particularly, to an indication arrangement for use in the sewing machine for indicating a range of pitch of a cloth advance suited for the selected zig-zag pattern.

Recently, there have been proposed various types of electrically operated sewing machines which provide a number of patterns of zig-zag sewing. The patterns are basically determined by two factors which are: the lateral movement of the thread carrying needle; and the pitch of advance or retreat of the cloth effected between the two succeeding stitches. The first factor, that is, the lateral needle movement, is generally controlled by a cam which is selected from a number of different cams, while the second factor, that is, the pitch of advance of the cloth, is controlled by a suitable pitch adjusting means such as a dial incorporated in the sewing machine. In order to reproduce a prearranged pattern, it is necessary to select a proper cam and also to set the dial to a position which provides a proper pitch of advance of the cloth.

In the conventional sewing machine, the pitch control dial has an index marking which is, as the dial is turned, selectively brought in register with numerical markings scaled adjacent and around the dial. These markings, however, only assist the operator to understand the pitch of cloth advance with respect to the registered numerical marking. Therefore, in such conventional sewing machines, it is necessary for the operator to make several trials of sewing before the sewing pitch control dial is set to an optimum position, or otherwise the dial has to be set empirically by the operator.

Although there have been proposed a pitch control dial with a plurality of concentric bars indicating an available range for the different cams, this arrangement needs time to find one bar corresponding to the selected cam. Furthermore, the number of the bars becomes larger as the cams are increased.

SUMMARY OF THE INVENTION

Accordingly, it is a primary object of the present invention to provide a sewing machine having an indication means for indicating a proper pitch of stitches for each of the cams.

In accomplishing these and other objects, a sewing machine having a thread carrying needle which is reciprocated in an axial direction thereof and is jogged in a lateral direction, a clath advancing mechanism for advancing a cloth in a direction perpendicular to the lateral direction at a predetermined pitch every after one stitch for forming a predetermined pattern of stitches, comprises, according to the present invention, a plurality of individual pattern information carrying means each provided for controlling the lateral movement of the thread carrying needle, means for selecting any one of the pattern information carrying means, means for producing a signal indicative of the selected pattern information carrying means, means for adjusting the pitch of cloth advance, and a plurality of illumination elements aligned along the pitch adjusting means. The sewing machine further comprises, according to the present invention, a circuit means connected between the signal producing means and the illumination elements for lighting at least one predetermined illumination element upon receipt of the selected signal so as to indicate an available range of the pitch for the selected pattern information carrying means by the lighted illumination element.

BRIEF DESCRIPTION OF THE DRAWINGS

These and other objects and features of the present invention will become apparent from the following description taken in conjunction with a preferred embodiment thereof with reference to the accompanying drawings, in which.

DETAILED DESCRIPTION OF THE INVENTION

Figure 1:
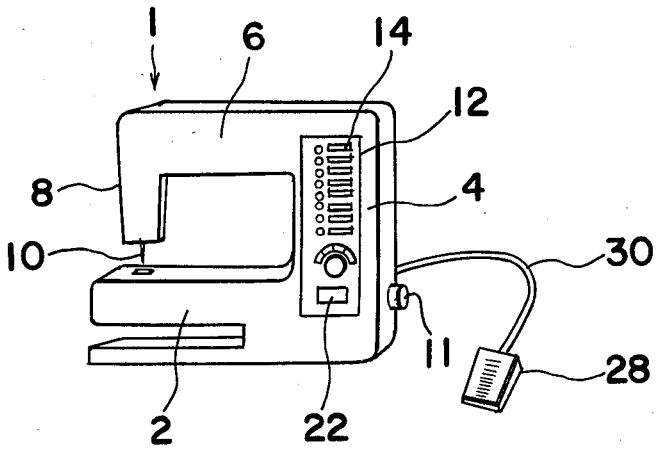
FIG. 1 is a perspective view of a sewing machine according to the present invention.

Before the description of the present invention proceeds, it is to be noted that like parts are designated by like reference numerals throughout the accompanying drawings.

Figure 2:
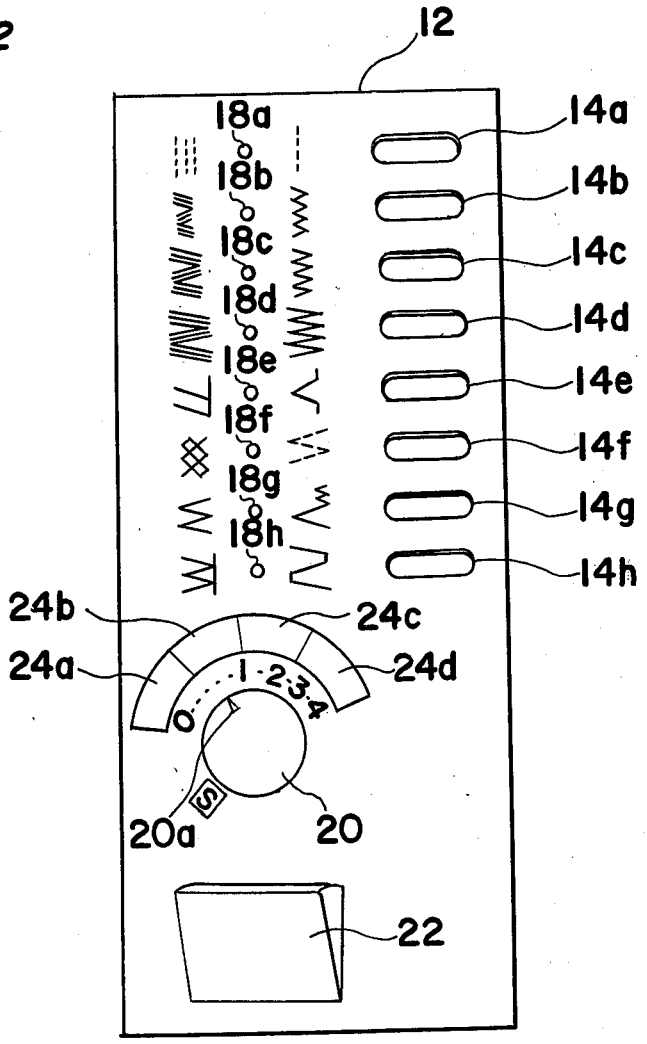
FIG. 2 is a fragmentary view of a control panel provided in a frame of the sewing machine.

Referring to FIG. 1, a sewing machine 1 includes a bed 2 from which rises a standard 4 supporting a bracket arm 6 overhanging the bed 2. The arm 6 supports a head 8 which has a needle 10 projecting outwardly and downwardly towards the bed 2. Disposed on the front surface of the standard 4 is control panel 12, as best shown in FIG. 2, including a plurality of, for example, eight buttons 14*a* to 14*h*, eight indication lamps 18*a* to 18*h* for the selected buttons 14*a* to 14*h*, respectively, a sewing pitch control dial 20 and a button 22 for effecting a retreat movement of the cloth. The sewing pitch control dial 20 has an index arrow 20*a* which is, as the dial 20 is rotated, selectively brought in register with character S and numerical markings scaled adjacent to and around the dial 20. When the arrow 20*a* points "0", the cloth under the needle 10 is held standstill so that the needle 10 can carry out the sewing repeatedly on the same place of the cloth. Upon rotation of the dial 20 to bring the index arrow 20*a* in register with one of the numerical markings, the cloth is advanced in a predetermined sewing pitch determined by the position of the dial 20 so rotated. The sewing pitch is greater as the weight of the numerical markings increases. When the dial 20 is rotated to a position S, the sewing pitch is controlled to cause the cloth to advance at a varying pitch. Indication lamps 24*a*, 24*b*, 24*c* and 24*d* in a shape of an arcade are provided around the dial 20 adjacent the numerical markings so that each indication lamp may indicate a predetermined range in the numerical markings. For example, the indication lamp 24*a*, 24*b*, 24*c* and 24*d* cover the numerical range 0 to 0.5, 0.5 to 1, 1 to 2.5 and 2.5 to 4, respectively. Each time the sewing pattern is selected by pushing one of the buttons 14*a* to 14*h*, one or more indication lamp 24*a* to 24*d* is lit to indicate a range of pitch suited for the selected pattern.

Two groups of sewing patterns are shown one on each side of a column of the indication lamps 18*a* to 18*h*. The sewing patterns of one group shown on the right-hand side of the respective lamps 18*a* to 18*h* are obtained when the arrow 20*a* is in register with one of the numerical markings whereas the sewing patterns of the other group shown on the left-hand side of the respective lamps 18*a* to 18*h* are obtained when the arrow 20*a* is in register with the character S.

Figure 3:
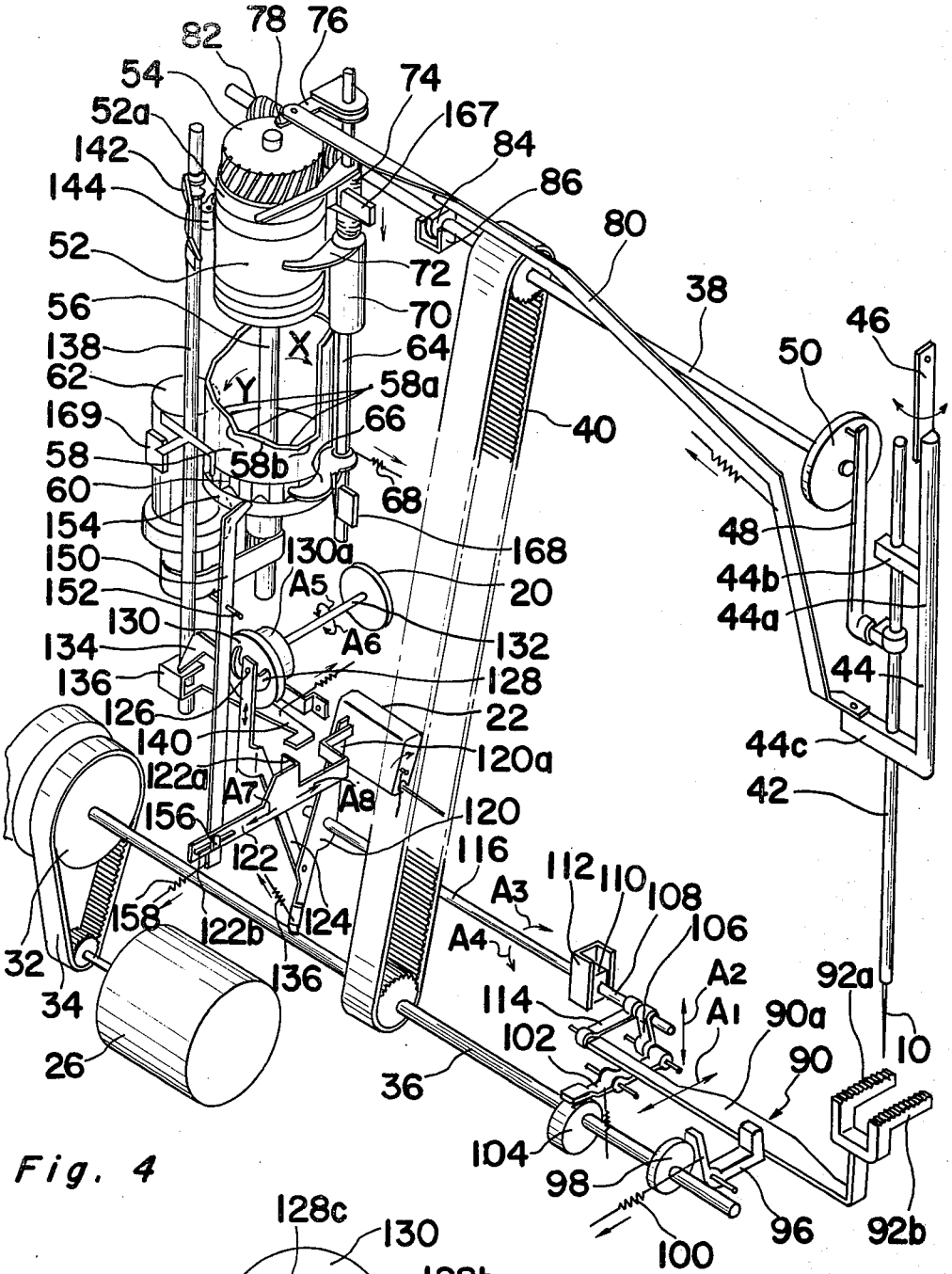
FIG. 3 is a schematic view of a needle actuating mechanism and a cloth moving mechanism which are incorporated in the sewing machine shown in FIG. 1.

Referring to FIG. 3, there is shown a mechanism of the sewing machine 1. The mechanism can be briefly divided into first and second sections, the first section being a needle actuating mechanism while the second section is cloth moving mechanism. Each of such mechanism is actuated by a motor 26 which is controlled by a foot-switch 28 connected to the machine 1 through a cable 30, as shown in FIG. 1. The rotation of the motor 26 is transmitted to a fly-wheel 32 through an endless belt 34. The fly-wheel 32 is rigidly mounted on a shaft 36 which is in common with a main shaft for the cloth moving mechanism. This shaft 36 is connected to another shaft 38 for the needle actuating mechanism through an endless belt 40 so that the shafts 36 and 38 can be rotated simultaneously with each other during rotation of the motor 26. Each mechanism is described in detail hereinbelow.

Needle Actuating Mechanism

The thread carrying needle 10 is affixed to a needle bar 42 which is slidably supported by an F-shaped framework 44 having an up-right bar 44*a* and two parallel bars 44*b* and 44*c* extending laterally from the bar 44*a*. The needle bar 42 is slidably inserted through holes formed in the bars 44*b* and 44*c*. A rectangular spring plate 46 has one end connected to the upper end of the up-right bar 44*a* and the other end connected to the frame of the sewing machine, whereby the F-shaped framework can undergo a swinging motion. At an intermediate portion between the bars 44*b* and 44*c*, the needle bar 42 is tightly held by a link 48 which is connected to a crank 50 mounted on the shaft 38. Therefore, the rotation of the shaft 38 is converted into the reciprocal movement of the needle bar 42 by the crank 50. The lateral jogging movement of the needle 10 can be obtained by the swing motion of the F-shaped framework 44. This swing motion is controlled by a cam mechanism.

The cam mechanism includes a plurality of cams 52 placed one above the other and rigidly connected to each other. Such cam arrangement 52 is also rigidly connected to a spur gear 54 and is rotatably mounted on a shaft 56 so that the gear 54 rotates together with the cam arrangement freely about the shaft 56. A rod 64 having a rectangular cross section is provided adjacent the cam arrangement 52 with it opposite ends rotatably journalled to the frame of the sewing machine. Mounted on the rod 64 is a cylindrical arm carrier 70 which slidably displaces along the rod 64. A step-formed drum 58 is rigidly mounted on the shaft 56 while a timing cam 60 is also rigidly mounted on the shaft 56. Since an upper annular end of the drum 58 is formed with a generally helical cam face composed of a plurality of steps 58*a* and a corresponding number of slopes 58*b* each positioned between every adjacent two of the steps 58*a*, the arm carrier 70 having its lower end resting on the upper annular end face of the drum descends or elevates along the rod 64 as the drum 58 is rotated in a direction as shown by the arrow X or in a direction as shown by the arrow Y, respectively, about the shaft 56 by a motor 62 connected to the shaft 56. The step-formed drum 58 is provided for supporting the cylindrical arm carrier 70 at a desired level. The position of the drum 58 shown in FIG. 3 supports the carrier 70 at the highest level. Upon rotation of the drum 58 in the direction X by the actuation of the motor 62, the carrier 70 is gradually lowered.

An arm 66 is mounted on the rod 64 at a position adjacent the timing cam 60 by means of a clicking clutch means (not shown), said clicking clutch means being so designed as to enable the arm 66 to rotate clockwise about and independently of the rod 64 and also to rotate counterclockwise together with the rod 64. A free end of the arm 66 remote from the rod 64 is engaged to the timing cam 60.

A spring 68 is connected to the arm 66 to bias the arm 66 and the rod 64 to rotate in a clockwise direction when viewed from top. The cylindrical shaped arm carrier 70 is slidably mounted on the rod 64 and carries an arm or cam follower 72 also mounted on the rod 64. A coil spring 74 mounted on the rod 64 biases the arm 72 and the arm carrier 70 downwardly with a bottom end of the arm carrier 70 held in contact with a stepped upper edge of the drum 58. Since the upper edge of the drum 58 is provided with steps 58*a* and slopes 58*b*, the rotation of the drum 58 moves the carrier 70 along the rod 64 to vary the level of the carrier 70. When the carrier 70 is slid along the slope 58*b* defined between every two neighboring steps 58*a* in the drum 58 for changing the level thereof, the arm 66 slides over a corresponding projecting portion of the timing cam 60. Thus, the arm 66 is pivoted by the rotation of the shaft 64 in a counterclockwise direction. In other words, during the movement of the carrier 70 along the rod 64 with its lower end sliding in contact with any one of the slopes 58*b* in the drum, a free end of the arm 66 slides over a corresponding one of the projections of the timing cam 60. Therefore, during the displacement of the arm 72 in the vertical direction, the arm 72 is disengaged from the cam arrangement 52.

On the other hand, when the carrier 70 is in contact with a flat edge or step 58*a* of the drum 58, the arm 66 is positioned in a recess defined between the two neighboring projections of the timing cam 60 and, hence, the arm 72 is held in contact with one of the cams in the cam arrangement 52. Rigidly mounted at upper portion of the shaft 64 is a disc plate 76 having a projection 78. This projection 78 is pivotally connected to a bar member 80 which extends to the bar 44*c* of the F-shaped framework 44. A worm gear 82 is mounted on the shaft 38 and is engaged to the spur gear 54 so that the rotation of the shaft 38 during the sewing operation is transmitted through the spur gear 54 to the cam arrangement 52.

The operation of the needle actuating mechanism is described hereinbelow.

Upon one rotation of the shaft 38, the needle 10 undergoes one reciprocation. Also the rotation of the shaft 38 causes the rotation of the cam arrangement 52 through the engagement between the worm gear 82 and the spur gear 54. The rotation of the cam arrangement 52 causes a jogging movement of the cam follower 72 by following projection lobes or recessed stations and, thus, the projection 78 is jogged accordingly. This jogging movement is transmitted to the F-shaped framework 44 through the bar member 80 to swing the needle 10 laterally. Thus, the zig-zag sewing can be effected according to a pattern determined by the selected cam in the cam arrangement 52 to which the arm 72 is then engaged. When it is necessary to change the cam, that is, to change the level of the arm 72, the motor 62 is turned on by a suitable switch means such as the one electrically coupled to the buttons 14*a* to 14*h* in a manner as will be described in detail later with reference to FIG. 6. When the motor 62 is so turned on, the shaft 56 is rotated to rotate the drum 58 and the timing cam 60. The rotation of the timing cam 60 causes the arm 66 to jog accordingly while the rotation of the drum 58 moves the cam follower 72 up or down together with the carrier 70 along the shaft 64. Since the vertical displacement of the cam follower 72 is caried out during the movement of the arm 66 over the projecting portion of the timing cam 60, the cam follower 72 is held clear of the cam arrangement 52.

Cloth Moving Mechanism

A rack member 90 having a pair of saw tooth edges 92*a* and 92*b* and an elongated bar portion 90*a* is movably accommodated in the bed 2 of the sewing machine 1. An L-shape block 96 journalled to the frame of the sewing machine has one end portion held in contact with one side edge of the bar portion 90*a* while the other end portion thereof is held in contact with a disc 98 which is eccentrically rigidly mounted on the shaft 36. The L-shaped block 96 is normally biased in one direction by a spring 100 with said other end portion thereof held in contact with the disc 98. Upon rotation of the shaft 36, the L-shaped block 96 is rocked to provide a lateral movement force to the rack member 90 in a direction as indicated by the arrow A1 in FIG. 3.

An elongated seesaw plate 102 pivotally supported at its substantially intermediate portion by a pin is provided adjacent the L-shaped block 96. This plate 102 has one end overlaying and engaged to a peripheral face of a disc 104 which is eccentrically rigidly mounted on the shaft 36. The other end portion of the plate 102 is hingedly connected to one end of an arm 106. The other end of the arm 106 is also hinged to a bar 108 which extends from a cubic block 110 slidably accommodated in a casing 112 of a substantially U-shaped cross section. The end of the bar portion 90*a* of the rack member 90 remote from the saw tooth edges 92*a* and 92*b* is hinged to one end of an arm 114 while the other end of the arm 114 is also hinged to the bar 108. In this construction, during the rotation of the shaft 36, the plate 102 undergoes a seesaw motion to move the bar 108 vertically in a direction as indicated by the arrow A2 in FIG. 3.

When the groove in the casing 112 is vertically oriented such as shown in FIG. 3, the bar 108 vertically moves as the cubic block 110 reciprocates in the groove of the casing 112. In this case, the rack member 90 is moved only in a vertical direction A2. Therefore, the cloth positioned above the saw tooth edges is held standstill. When the groove in the casing 112 is slanted in one direction as a result of rotation of a shaft 116 connected to the casing 112 in a direction as indicated by an arrow A3, the cubic block 110 reciprocates accordingly along the groove in the casing 112. In this case, the rack member 90 undergoes such a motion that an end portion of the bar portion 90*a* of the rack member 90 adjacent the toothed edges 92*a* and 92*b* describes an oval orbit in a counterclockwise direction, when viewed from the right-hand end, whereby the cloth is advanced. The pitch of advance is controlled by the setting of the sewing pitch control dial 20 which determines the angle through which the casing 112 reciprocatingly rotates together with the shaft 116.

On the other hand, when the groove in the casing 112 is slanted in the other direction as a result of rotation of the shaft 116 in a direction as indicated by the arrow A4, the cubic block 110 reciprocates accordingly along the groove for causing the rack member 90 to move following a similar oval orbit in a clockwise direction when view from the right-hand end. In this case, the cloth is retreated. The manner in which the rotation of the shaft 116 is controlled is described hereinbelow.

Figure 4:
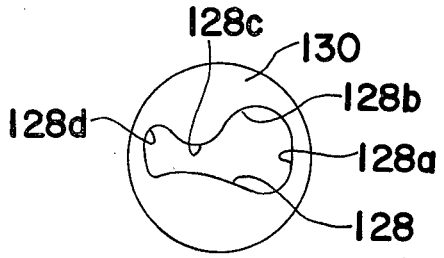
FIG. 4 is a plan view of a disc shown in FIG. 3.

An elongated plate 120 is rigidly connected to the end of the shaft 116 remote from the casing 112. One end portion 120*a* of the plate 120 is pivotally connected to a plate 122, so that the plate 122 moves laterally as a result of rotation of the plate 120. The other end portion of the plate 120 is pivotally connected to a plate 124 which has a pin projection 126 at the end thereof remote from the plate 120. This pin projection 126 is engaged to an edge of a detent recess 128 formed in a disc plate 130. The recess 128 as best shown in FIG. 4 has a predetermined pattern defined by portions 128*a*, 128*b*, 128*c* and 128*d*. The disc 130 is eccentrically connected to a shaft 132 which in turn is connected to the dial 20 described above. Since the plate 120 is biased by a spring 136 about the shaft 116 in a clockwise direction when viewed from right, the pin projection 126 is held in contact with an upper edge of the detent recess 128. When the disc 130 is held in a position as shown in FIG. 3, the edge portion 128*b* of the recess 128 is held in contact with the pin projection 126. It is to be noted that the engagement of the pin projection 126 at the portion 128*b* brings the casing 112 in a position with the groove thereof oriented in a vertical direction as shown. At this time, the dial 20 is in position with the arrow 20*a* held in register with the "0" marking. Upon rotation of the disc 130 in a direction A5, the pin projection 126 comes into contact with the portion 128*a* of the recess 128. Therefore, the plate 124 is raised upwardly to allow rotation of the shaft 116 in the direction A3. Thus, the casing 112 is slanted to effect the orbitary movement of the rack member 90 in such a manner as to advance the cloth. At this time, the dial 20 is in position with the arrow 20*a* held in register with one of the numeral markings.

The disc 130 is coupled with an auxiliary disc 130*a* having a smaller diameter than that of the disc 130. This auxiliary disc 130*a* is also eccentrically connected to the shaft 132. Provided under the auxiliary disc 130*a* is an arm 134 having one end portion pivotally connected to the frame of the sewing machine while the other end is held in contact with a platform 136 slidably mounted on a shaft 138 extending in parallel to the shaft 56. An arm 140 extends from the platform 136 with the free end thereof normally terminating adjacent and above a face 122*a* formed in the plate 122. Since the arm 140 is rigidly connected to the shaft 138, the rotation of the arm shaft 140 accordingly results in rotation of the arm 140. Another arm 142 is also rigidly mounted on the shaft 138 at upper portion thereof. This arm 142 is held in contact with a hinged V-shaped block 144 which is in turn held in contact with the uppermost cam 52*a* in the cam arrangement 52. The uppermost cam 52*a* is provided for controlling the cloth movement. The rotation of the cam arrangement 52 results in a jogging motion of the V-shaped block 144 and also the arm 142. Therefore, the shaft 138 is rotated. This rotation of the shaft 138 is transmitted to the arm 140. Normally, since the arm 140 is free from any element, the rotation or jogging movement of the arm 140 is not transmitted to further element. When the dial 20 is turned to a direction A6, however, the recess 128 is rotated to push down the plate 124 as the pin projection 126 slides along the portion 128*c*. Therefore, the plate 122 is forcibly pushed to a direction A7. The further rotation of the dial 20 in the direction A6 pushes down the arm 134 by the auxiliary disc 130*a*, so that the platform 136 is pushed down to lower the arm 140. Thereafter, the pin projection 126 slides into the portion 128*d* to substantially raise the plate 124 for moving the plate 122 towards the direction A8. As a consequence, the face 122*a* of the plate 122 comes into contact with the free end of the arm 140. It is to be noted that this is effected as the dial 20 is brought to a position with the arrow 20*a* registered with the "S" marking. The establishment of such connection between the arm 140 and the face 122*a* transmits the jogging movment of the arm 140 through the plates 122 and 120 to the shaft 116, so that the casing 112 is slanted in the direction A3 or A4 with respect to the jogging of the arm 140. Thus, the movement of the cloth is varied.

Figure 5:
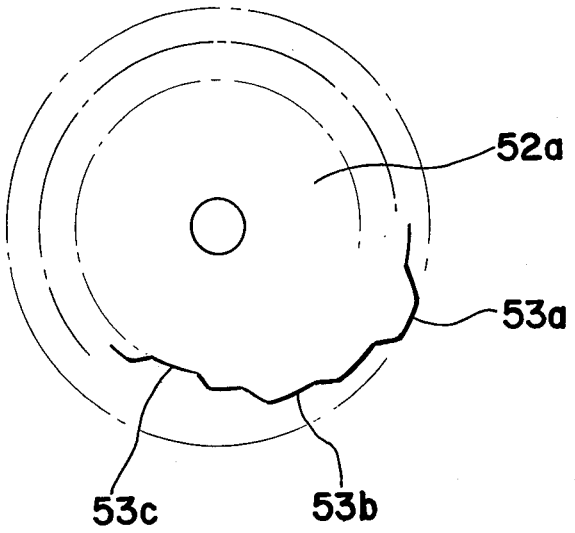
FIG. 5 is a plan view of a cam for controlling the cloth movement.

Referring to FIG. 5, there is shown one example of the cloth moving cam 52*a* having a most projecting portion 53*a*, normal level portion 53*b* and a recessed portion 53*c*. When the V-shaped block 144 slides over the projecting portion 53*a*, the shaft 116 is turned to the direction A4 to retreat the cloth. When the V-shaped block 144 slides over the normal level portion 53*b*, the shaft 116 is held in such a position as to maintain the casing 112 vertically as shown in FIG. 3, and when the V-shaped block 144 slides over the recessed portion 53*c*, the shaft 116 is turned to the direction A3 for advancing the cloth.

An elongated plate 150 is pivotally supported by a pin 152 with upper end thereof held in contact with a cam 154 positioned under the timing cam 60 and rigidly mounted on the shaft 56. The other end of the plate 150 is provided with a pin projection 156 which is slidably accommodated in an elongated groove 122*b* formed in the plate 122. A spring 158 is provided for urging the upper end of the plate 150 to the cam 154. Since the biasing force of the spring 158 is larger than that of the spring 136, the movement of the plate 122 particularly in the direction A8 is restricted by the plate 150. In other words, the pin projection 156 limits the lateral movement of the plate 122 within a distance defined by the effective length of the groove 122*b* between the pin projection 156 and the left end of the groove 122*b*. For example, when carrying out a straight stitch, the upper end of the plate 150 will be held in contact with the most projecting portion of the cam 154 so that the effective length of the groove 122*b* between the pin projection 156 and the left end of the groove 122*b* will be considerably large. Thus, upon rotation of the dial 20 to a large numbered position, the shaft 116 can be turned to the direction A3 through a large angle. In other words, stitching is effected at an interval of a relatively large pitch while the cloth is advanced. By all means, it is possible to advance the cloth with a small pitch for this straight stitch by simply turning the dial 20 to a smaller number. On the other hand, when carrying out a button hole stitch, it is necessary to stitch the same place repeatedly. In this case, the upper end of the plate 150 will be held in contact with the most detent portion of the cam 154 so that the effective length of the groove 122*b* between the pin projection 156 and the left end of the groove 122*b* will be zero. Therefore, the plate 122 will not be moved to the direction A8 so as to incline the casing 112 in the direction A3, regardless of turning of the dial 20.

The button 22 is positioned adjacent the upper end of the plate 120 for allowing, when the button 22 is pushed, the shaft 116 to rotate in the direction A4. Thus, the retreat movement of the cloth can be effected during the pushing of the button 22.

Figure 6:
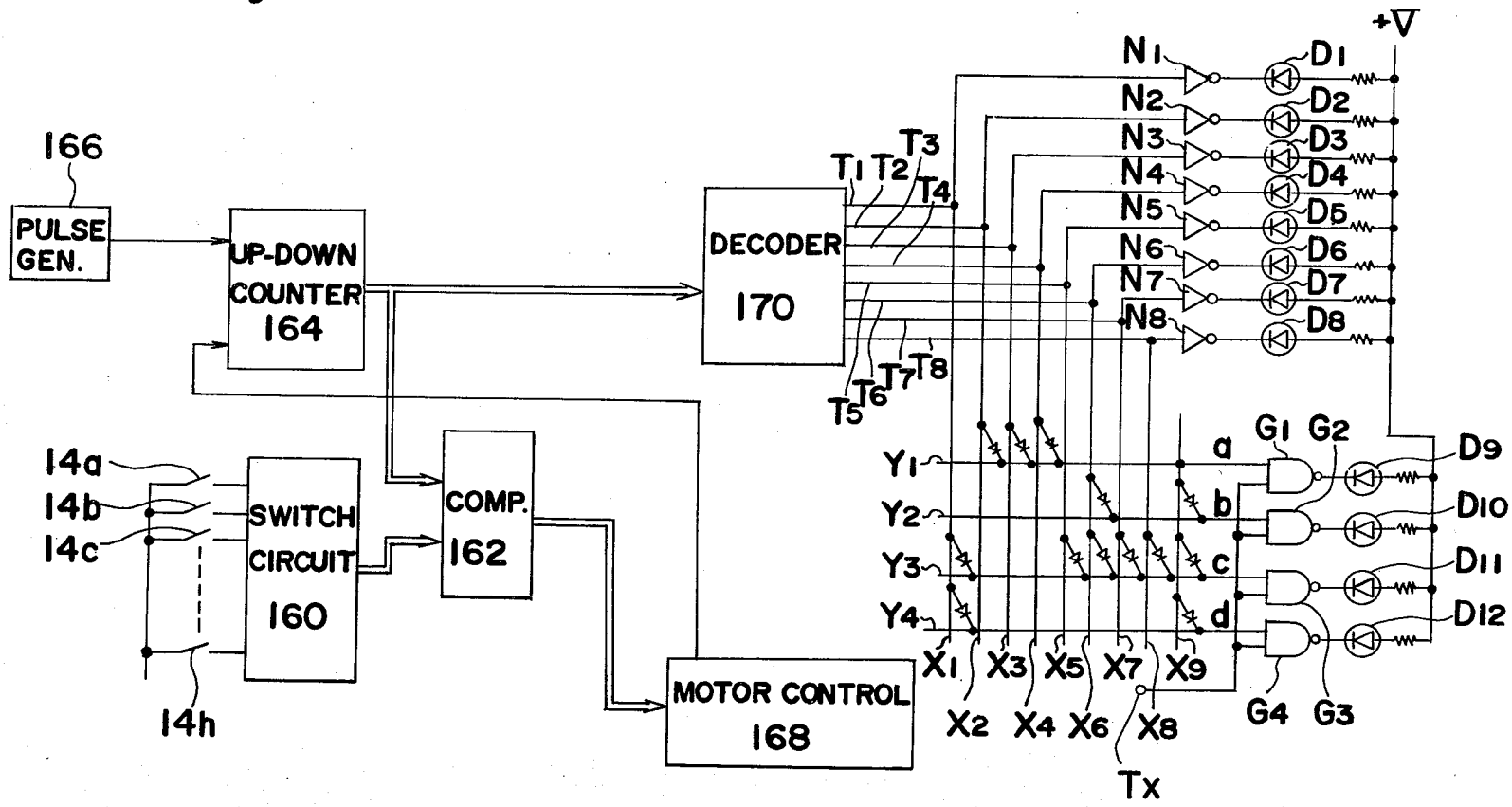
FIG. 6 is a circuit diagram, partly shown in blocks, incorporated in the sewing machine.

Referring to FIG. 6, there is shown a block diagram of a control circuit for controlling the mechanism described above. The control circuit includes a switching circuit 160 which produces a binary coded decimal (BCD) signal upon receipt of high level signal from one of the push button switches 14*a* to 14*h* described above. For example, when the first button switch 14*a* is turned on, BCD signal indicative of "1" is produced from the switch circuit 160. Similarly, when the second button switch 14*b* is turned on, BCD signal indicative of "2" is produced, and so on. Such BCD signal from the circuit 160 is applied to a comparator 162 in which the BCD signal is compared with a similar BCD signal from an up-down counter 164. The up-down counter 164 counts up or down each time a pulse signal is applied thereto from a pulse generator 166. The pulse generator 166 is constituted by a reed switch 168 (FIG. 3) positioned closely adjacent the arm 66. The reed switch 168 is turned on when the arm 66 is pushed in a counterclockwise direction by the contact between the arm 66 and the projecting portion of the timing cam 60. Since the projecting portion of the timing cam 60 pushes the arm 66 each time the arm 72 is shifted one step higher or lower from the present position, the pulse from the pulse generator 166 indicates a step change in the cam selection. Therefore, the up-down counter 164 produces the BCD signal indicative of the position of the arm 72 with respect to the cam arrangement 52. For example, when the arm 72 is positioned in alignment with the uppermost cam, the up-down counter 164 produces the BCD signal indicative of "1". Thereafter, if the arm 72 is moved to the second cam from the uppermost one, the pulse generator 166 generates a pulse to count up the contents of the counter 164 from "1" to "2". Therefore, at the moment when the arm 72 is positioned in alignment with the second cam from the uppermost one, the up-down counter 164 produces the BCD signal indicative of "2". Whether the pulse from the pulse generator 166 is to be counted up or down in the counter 164 is determined by a signal obtained from a motor control 168. When the motor control 168 controls the motor 62 to rotate in one direction, counting up is effected in the counter 164. On the other hand, when the motor control 168 controls the motor 62 to rotate in the other direction, counting down is effected in the counter 164. The difference in value in the BCD signal between that from the switch circuit 160 and that from the up-down counter 164 is applied to the motor control 168. When the difference is positive, that is, when the BCD signal from the switch circuit 160 is larger than that from the up-down counter 164, the motor control 168 controls the motor 62 to rotate in said one direction. On the other hand, when the difference is negative, that is, when the BCD signal from the switch circuit 160 is smaller than that from the up-down counter 164, the motor control 168 controls the motor 62 to rotate in said other direction. By all means, when the BCD signals from the switch circuit 160 and from the up-down counter are equal, the comparator 162 produces zero level signal to maintain the motor 168 in an inoperative condition.

After the motor control 168 is actuated to position the arm 72 to such required position as selected by the pushing of one of the button switches 14*a* to 14*h*, the up-down counter 164 produces the BCD signal indicative of the position of the arm 72. This BCD signal from the up-down counter 164 is applied to a decoder 170 having eight output terminals T1 to T8. For example, when the BCD signal from the up-down counter 164 is indicative of numeral "3", a high level signal is produced from the terminal T3 of the decoder 170. In general, the decoder 170 produces a high level signal from one of the terminals T1 to T8 which corresponds to the BCD signal obtained from the up-down counter 164.

The output terminals T1 to T8 are, respectively, connected through inverters N1 to N8 to light emitting diodes D1 to D8. Each of the diodes D1 to D8 is in turn connected through a suitable resistor to a common source of electric power +V. It is to be noted that the diodes D1 to D8 correspond to the indication lamps 18*a* to 18*h*, respectively, shown in FIG. 2.

In addition to above, the output terminals T1 to T8 are also connected, respectively, to lines X1 to X8 which are aligned in a column. These lines X1 to X8 constitute a network presented in a form of matrix together with four lines Y1 to Y4 which are aligned in a row. A diode is connected at the intersection between the lines X1 and Y3 in a forward biased direction from the line X1 to the line Y3. In a similar manner, a diode is connected at the intersections between the lines X1 and Y4, lines X2 and Y1, lines X3 and Y1, lines X4 and Y1, lines X5 and Y3, lines X6 and Y2, lines X6 and Y3, lines X7 and Y3, and lines X8 and Y3. The matrix circuit further includes another line X9 in the column which is connected to the line Y1. A diode is further provided at the intersections between the lines X9 and Y2, lines X9 and Y3, and lines X9 and Y4. The lines Y1 to Y4 are connected, respectively, to one input of NAND gates G1 to G4 and, in turn, to light emitting diodes D9 to D12. Each of the diodes D9 to D12 is connected through a suitable resistor to the common source of electric power +V. It is to be noted that these diodes D9 to D12 correspond to the indication lamps 24*a* to 24*d*, respectively, shown in FIG. 2. The other input of each NAND gate is connected to a terminal Tx which is normally held high during the time the control circuit is turned on. When it is not required to adjust pitch of the stitches, a low level signal is applied to terminal Tx to prohibit the actuation of diodes D9–D12. The operation of the control circuit is described hereinbelow.

Assuming that the arm 72 is now in engagement with the third cam from the uppermost cam in the cam arrangement 52, the up-down counter 164 produces BCD signal indicative of "3", thus the decoder 170 produces a high level signal from the terminal T3. This high level signal is applied to the inverter N3 so that the light emitting diode D3 can be lit. In addition, the high level signal from the terminal T3 is also applied to the line X3 for applying the high level signal to the line Y1 and also through the line X9 to the lines Y2, Y3 and Y4. Therefore, the NAND gates G1 to G4 are actuated to light all the diodes D9 to D12.

In the above described case, it is indicated that, for sewing a given pattern of stitches represented by the third cam, the pitch control dial 20 may be adjusted to any desired position shown by the numerical markings "0" to "4".

In the next step, if the seventh button 14*g* from the top is pushed, the switch circuit 160 produces a BCD signal indicative of a numeral "7". This BCD signal of "7" is compared with the BCD signal from the up-down counter 164. Since the arm 72 is now in contact with the third cam as described above, the counter 164 provides BCD signal of "3" to the comparator 162. The result of the comparison is that the BCD signal from the switch circuit 160 is greater by "4" than the BCD signal from the counter 164. Therefore, the motor control 168 actuates the motor 62 to revolute in one direction to lower the level of the arm 72. During the descent of the arm 72, the pulse is applied to the counter 164 to count up the number until the number coincides with the number from the switch circuit 160, that is, "7". When the number from the counter 164 coincides with the number from the switch circuit 160, the motor control 168 stops the motor 62 to complete the step. Therefore, the decoder 170 produces a high level signal from the terminal T7 for illuminating the diode D7 and for illuminating the diode D11. In this case, it is indicated that, for sewing of a given pattern of stitches represented by the seventh cam, the pitch control dial 20 should be adjusted to any one of the positions shown by the numerical markings "1" to "2.5".

It is to be noted that this indication of pitch range does not mean that the sewing machine 1 only operates within said range, but means that the pattern of a reasonable shape can be obtained when the dial 20 is so turned as to bring the index arrow 20*a* in register with the numerical markings ranging from "1" to "2.5".

It is also to be noted that during the actuation of the motor 62, the content of the counter 164 is sequentially counted up from "3" to "7" so that the output from the decoder 170 can produce a high level signal sequentially from the terminal T3 to the terminal T7.

It is further to be noted that the diodes employed in the matrix circuit can be distributed in other crossing points than the points described above for changing the combination of lighting the light emitting diodes D9 to D12 in the consideration of the type and/or number of cams employed in the cam arrangement 52.

Since the sewing machine according to the present invention indicates the available range for the pitch of switches, the operator can easily reproduce the stitch pattern by turning the dial 20 to bring the index arrow 20*a* in register with a numerical marking in the indicated range.

Although the present invention has been fully described by way of examples with reference to the accompanying drawings, it is to be noted that various changes and modifications are apparent to those skilled in the art. For example, the number of the indication lamps 24*a* to 24*d*, that is, the number of the light emitting diodes D9 to D12 can be varied to any desired number. Moreover, the pattern information carrying means which has been described as been constituted by cam arrangement can be constituted by electric memory device using a micro-computer in which an address circuit in the memory device may be so arranged as to produce coded signal corresponding to the selected button switch. In this case, such coded signal can be used for lighting the required light emitting diodes for the indication of the available range of the pitch. Therefore, such changes and modifications, unless they depart from the true scope of the present invention, should be construed as included therein.

What is claimed is:

1. A sewing machine having a thread carrying needle which is reciprocated in an axial direction thereof and is jogged in a lateral direction, a cloth advancing mechanism for advancing a cloth in a direction perpendicular to the lateral direction at a predetermined pitch after every one stitch for forming a predetermined pattern of stitches, said sewing machine comprising:

a plurality of individual pattern information carrying means each provided for controlling the lateral movement of the thread carrying needle;

means for selecting any one of said pattern information carrying means;

means for producing a selected signal having a value indicative of the selected pattern information carrying means;

means for adjusting the pitch of cloth advance;

a plurality of illumination elements aligned along the pitch adjusting means; and circuit means connected between the signal producing means and the illumination elements for lighting at least one predetermined illumination element upon receipt of the selected signal, said lighted illumination element indicating an available range of the pitch for the selected pattern information carrying means;

some of the possible values of said selection signal lighting more than one of said predetermined illumination elements.

2. A sewing machine as claimed in claim 1, wherein said individual pattern information carrying means is a cam.

3. A sewing machine as claimed in claim 2, wherein said signal producing means includes a decoder element having a plurality of output terminals, the number of said output terminals corresponding to the number of the cams, for producing a signal from a terminal corresponding to the selected cam.

4. A sewing machine as claimed in claim 1, wherein said illumination elements are light emitting diodes.

5. A sewing machine as claimed in claim 1, wherein said pitch adjusting means is presented in a form of dial.

6. A sewing machine as claimed in claim 5, wherein said plurality of illumination elements are aligned in a form of arc concentrically around the dial.

7. The sewing machine of claim 3, wherein said circuit means comprises an $M \times N$ diode switching matrix, said matrix having M row lines corresponding to the number of said illumination elements and N column lines corresponding to the number of said individual pattern information carrying means, and a plurality of diodes, each of said plurality of diodes connecting a column line corresponding to an individual pattern to one of said illumination elements which corresponds to an available range of the pitch for that individual pattern.

8. A sewing machine having a thread carrying needle which is reciprocated in an axial direction thereof and is jogged in a lateral direction, a cloth advancing mechanism for advancing a cloth in a direction perpendicular to the lateral direction at a predetermined pitch after every one stitch sewing machine comprising:

a plurality of individual pattern information carrying means each provided for controlling the lateral movement of the thread carrying needle;

means for selecting any one of said pattern information carrying means;

means for producing a selected signal having a value indicative of the selected pattern information carrying means;

means for adjusting the pitch of cloth advance;

a plurality of illumination elements aligned along the pitch adjusting means; and circuit means connected between the signal producing means and the illumination elements for lighting at least one predetermined illumination element upon receipt of the selected signal, said circuit means including an $M \times N$ diode switching matrix, said matrix having M row lines corresponding to the number of said illumination elements and N column lines corresponding to the number of said individual pattern information carrying means, and a plurality of diodes, each of said plurality of diodes connecting a column line corresponding to an individual pattern to one of said illumination elements which corresponds to an available range of the pitch for that individual pattern said illumination elements indicating an available range of the pitch for the selected pattern information carrying means.

9. A sewing machine having a thread carrying needle which is reciprocated in an axial direction thereof and is jogged in a lateral direction, a cloth advancing mechanism for advancing a cloth in a direction perpendicular to the lateral direction at a predetermined pitch after every one stitch for forming a predetermined pattern of stitches, said sewing machine comprising:

a plurality of stitch pattern cams, each providing information indicative of a particular stitch pattern;

a cam follower for reading the stitch pattern information from said cam;

means for selecting a desired cam from said plurality of stitch pattern cams;

motor driving means for moving said means for selecting to move said cam follower to the desired cam;

means for sensing the position of said cam follower and producing a desired pattern output signal representative of this position; and means responsive to said desired pattern output signal for indicating the available range of pitch for said desired cam.

10. The sewing machine of claim 9, further comprising:

means for inhibiting the operation of said means for indicating to prevent the display of information relating to the available range of pitch of said desired cam.

11. The sewing machine of claim 9, wherein said means for indicating provides a range of pitch for said desired cam independently from the relative location of said desired cam in relation to the others of said plurality of stitch pattern cams.

* * * * *